US005511681A

United States Patent [19]

Podd

[11] Patent Number: 5,511,681

[45] Date of Patent: Apr. 30, 1996

[54] BULKHEADLESS LINER

[76] Inventor: Stephen D. Podd, 1321 Sherbrooke Street West, Apt. E1, Montreal, Quebec, Canada, H3G-1J4

[21] Appl. No.: 191,773

[22] Filed: Feb. 4, 1994

[51] Int. Cl.[6] ..... B65D 25/14; B65G 65/34

[52] U.S. Cl. ..... 220/403; 220/1.5; 220/404; 105/423

[58] Field of Search ..... 220/403, 404, 220/1.5; 414/469; 105/423; 52/645, 656.1; 296/39.1

[56] References Cited

U.S. PATENT DOCUMENTS

| | | | |
|---|---|---|---|
| 3,951,284 | 4/1976 | Fell et al. | 214/41 R |
| 4,054,226 | 10/1977 | Bjelland et al. | 220/63 R |
| 4,334,812 | 6/1982 | Delatush | 410/52 |
| 4,441,627 | 4/1984 | Takeuchi | 220/461 |
| 4,574,986 | 3/1986 | Baris et al. | 222/94 |
| 4,799,607 | 1/1989 | Podd | 222/94 |
| 4,875,596 | 10/1989 | Lohse | 220/403 |
| 4,884,722 | 12/1989 | Podd | 222/535 |
| 5,040,693 | 8/1991 | Podd, Sr. et al. | 220/1.5 |

*Primary Examiner*—David Scherbel
*Assistant Examiner*—Reginald L. Alexander
*Attorney, Agent, or Firm*—John C. Smith

[57] ABSTRACT

A container liner constructed of flexible material which has sleeves at the front end of the liner. Brace bars are inserted through the sleeves and attached on or near the front wall of the container. The brace bars allow the liner to be quickly secured to the container without damage caused by nailing etc. The rear end of the liner is folded and sealed to form an integral discharge funnel at the rear door of the container. The length of the liner is smaller than the length of the container, such that the funnel extends out from the liner and is supported by the floor of the container when the liner is filled. A discharge sleeve is attached to the discharge funnel to facilitate unloading. The discharge sleeve may be tied off or sealed by any suitable means while the liner is filled. The shorter length of the liner eliminates the need for a bulkhead, and the integral discharge funnel eliminates the need for corner bevel units.

28 Claims, 18 Drawing Sheets

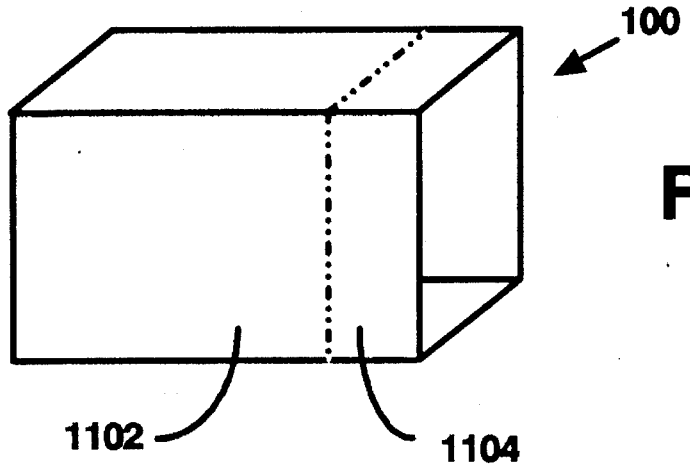
Figure 11-A
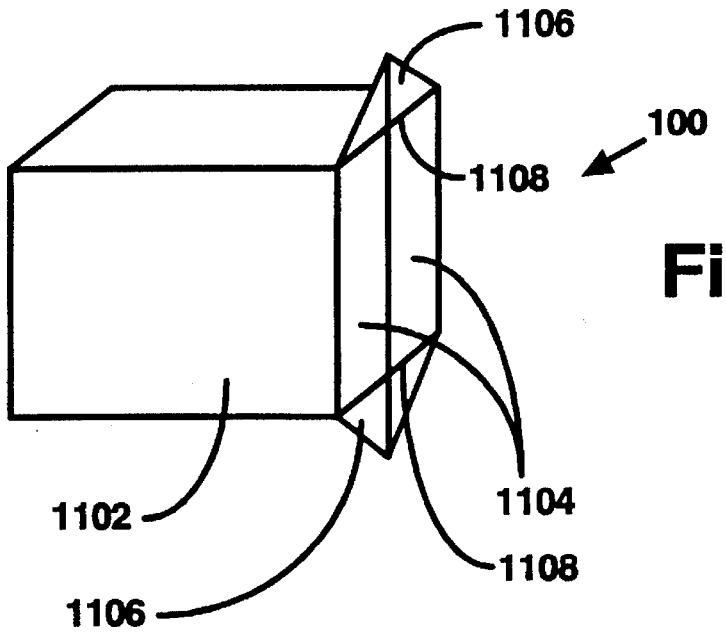
Figure 11-B
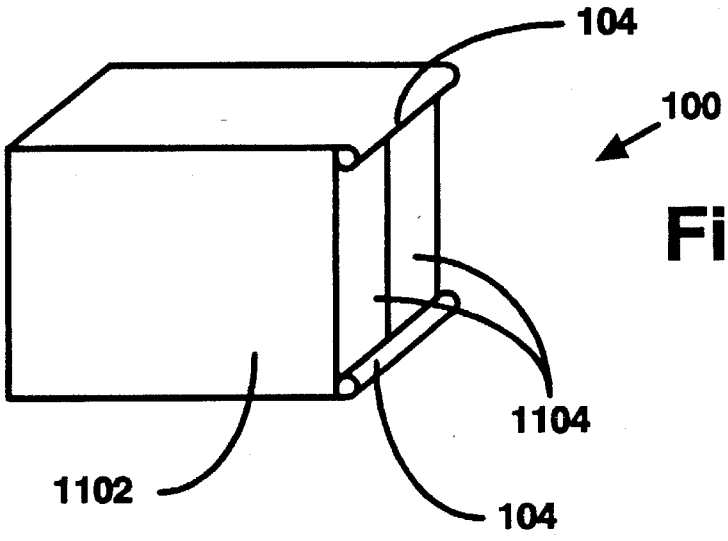
Figure 11-C

BULKHEADLESS LINER

BACKGROUND OF THE INVENTION

1. Technical Field

The present invention relates to container liners. In particular, bulkheadless container liners designed for bulk transport of commodities by commercial transport vehicles, and liners with integral discharge funnels.

2. Background Art

Transportation of bulk commodities has been implemented using a variety of methods. A common method is to use a vehicle designed solely for bulk commodity transport. Vehicles of this type are available in both motor and rail transport forms. Examples of these vehicles are tank trucks used for bulk liquid transport, and rail cars with discharge funnels integrated into the floor of the container to allow unloading of granular commodities such as grain, sugar, coal, etc. A disadvantage to this type of transport solution is that because the vehicle is dedicated to a particular form of cargo, it creates a backhaul problem. A backhaul is the cargo carried by the vehicle on the return trip. Thus, the specialized nature of the vehicle reduces the probability that cargo will be carried in both directions of the trip and therefore reduces the productivity of the vehicle. In addition to the backhaul problem, the costs involved with cleaning and inspection of a vehicle designed for a particular cargo can increase the cost of shipping the cargo. For example, when the vehicle is used to carry food products, great care must be used to avoid contamination. For these reasons, it is desirable that a general purpose vehicle be provided the ability to carry a variety of cargo types.

Attempts have been made to use general purpose vehicles for transport of granular cargo. One known method has been to load the cargo into drums and then securing the drums inside the transport vehicles. While tending to reduce the exposure to air which may contaminate some cargo, this method has proven to be unsuitable for many food items due to the remaining possibility of contamination, and the desirability of avoiding metal contact with the food items. A further disadvantage to this method is the high cost of using drums for shipment. Not only are the drums themselves expensive, but filling, loading and unloading are expensive labor consuming activities. In addition, as the drums are loaded onto the vehicle, they must be restrained or else the movement of the vehicle may cause the drums to be damaged or overturned in transit. The expense of using drums is further increased due to the need to provide pallets to rest the drums on during transit. The drums must be disposed of or returned. In the first instance, the cost of the pallets become part of the cost of the cargo. In the second instance, the space taken by the pallets during the return trip reduces the amount of usable cargo space.

Bag, or pillow, containers have been developed which are sealed to prevent exposure to ambient air. To avoid movement of this type of container, restraining straps are used to hold the bag in place. In addition to the straps, bulkheads are often required to hold the ends of the bags in place when vehicle doors are opened. Bulkheads are typically expensive and time consuming to install. Further, these bags often require inner liners when transporting food products or other items requiring approval from government agencies such as the U.S. Food and Drug Administration.

Another known method is to secure a deformable liner to the inside walls of a cargo vehicle. The bottom of the liner rests on the floor of the vehicle. As the vehicle is loaded, the cargo presses the liner against the floor and walls of the vehicle. While useful for some types of cargo, this method is undesirable for food or other products which may be subject to contamination. To further protect the cargo, sealed bags have been developed to hold cargo in a clean, contained environment during shipping. These bags allow bulk commodities to be shipped using standard multipurpose cargo containers.

An attempt to provide a better solution to the issue of transportation of bulk cargo has been the development of sealable liners for use with general purpose transport containers. Typically, a flexible liner generally conforming to the internal shape of the container is secured to the inside of the container by straps and/or nailing the liner to convenient location within the container. The liner is held in place by a removable bulkhead to provide both for safety when loading or unloading, and for reducing the possibility of cargo loss if the liner should be damaged by movement when the container doors are opened.

The liner is typically unloaded by a variety of means. Pumps can be used to pull the cargo out of the liner. Likewise, a variety of mechanisms for lifting the front end of containers have been developed to allow the cargo to drain from a discharge port in the rear of the liner. The lifting approach has created some additional problems in that containers tend to be generally boxlike in shape. As a result, when granular cargo is unloaded, some of the cargo flows out the discharge port while some is trapped in the corners of the container liner. This, in turn, requires either extra labor to unload the remaining cargo or the lost value if the remaining trapped cargo is discarded.

The trapped cargo problem was addressed by the development of rigid angled corner units placed at the lower rear corners of the container. These corner units support the lower corners of the liner and act as a funnel, directing the cargo flow to the discharge port and away from the corners. Of course, the corner units have disadvantages similar to bulkheads in that the cost of the corner units, both in their construction cost and the cost to install and position them for each shipment, adds to the cargo cost.

Disadvantages associated with the prior art forms of bulk container liners are that they require extra labor to securely attach the liner to the proper locations within the container. Further, the attachment methods often include nailing or otherwise securing the liner to the inside of the container in a manner which causes some damage to the container itself. Likewise, the bulkheads and corner units increase the cost of the cargo due to the materials required to build the bulkhead and corner units as well as the labor to install them.

While addressing the basic desirability of using general purpose transport vehicles to move bulk granular cargo, the prior art has failed to provide a single bulk transport system which is inexpensive to manufacture, is sealed to minimize spillage, reduces contamination due to exposure to ambient air or air pockets, and can be used without straps, or other restraining devices, does not require bulkheads, and can be efficiently unloaded without corner units.

SUMMARY OF THE INVENTION

The present invention solves the foregoing problems by providing a container liner constructed of flexible material which has sleeves at the front end of the liner to accept brace bars attached on or near the front wall of the container. The brace bars allow the liner to be quickly secured to the container without damage caused by nailing etc. The rear end of the liner is folded and sealed to form an integral discharge funnel at the rear door of the container. The length of the liner is smaller than the length of the container, such that the funnel extends out from the liner and is supported by the floor of the container when the liner is filled. A discharge sleeve is attached to the discharge funnel to facilitate unloading. The discharge sleeve may be tied off or sealed by any suitable means while the liner is filled.

BRIEF DESCRIPTION OF THE DRAWINGS

FIG. 11A–11C is an alternative embodiment showing a method of forming the sleeves from the end of the liner.

DESCRIPTION OF THE PREFERRED EMBODIMENT

Figure 1:
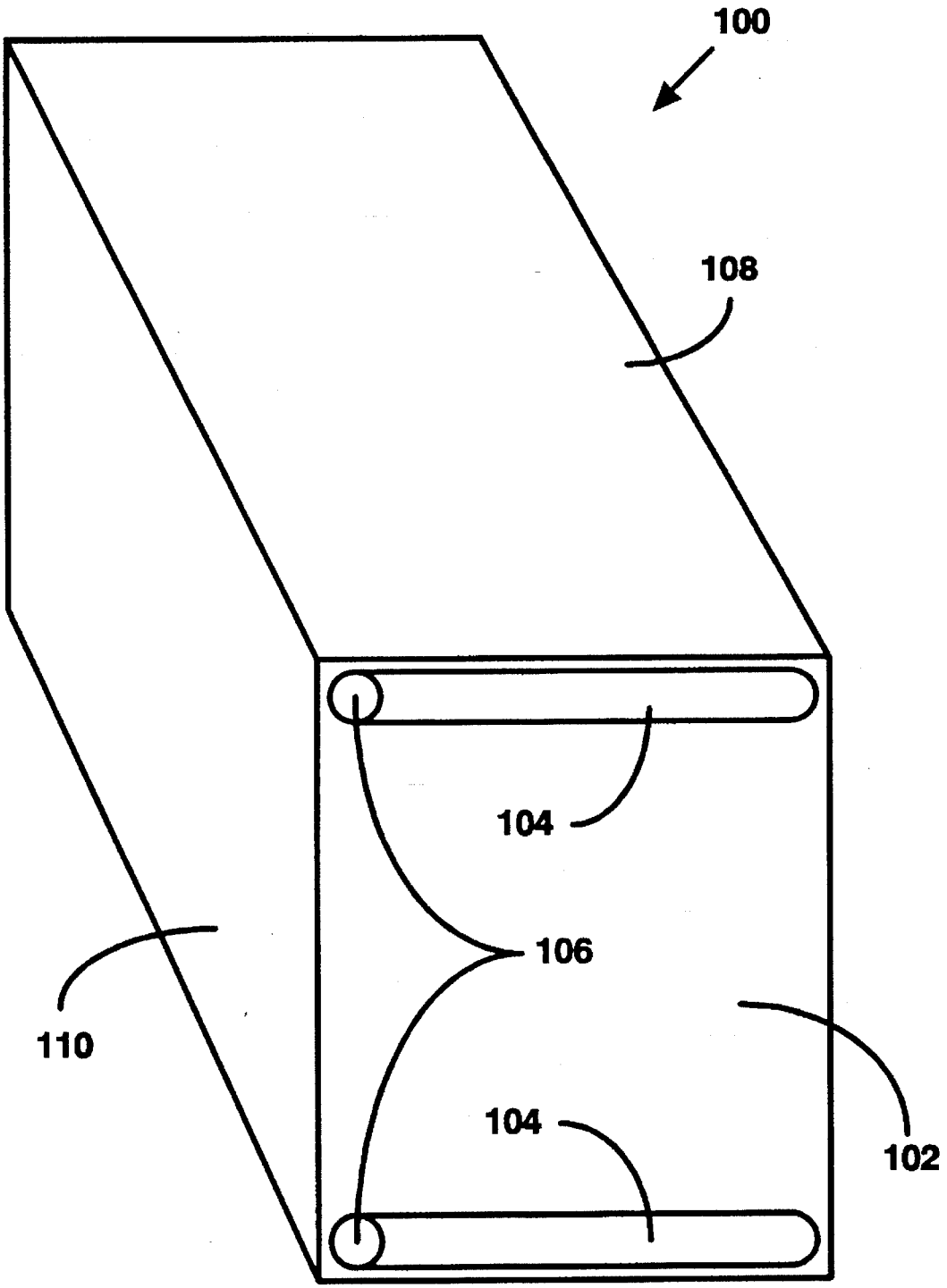
FIG. 1 is shows a front perspective view of the liner with two sleeves.

Referring to FIG. 1, a front perspective view of bag 100 which forms the liner is shown. Top panel 108, side panels 110, a floor panel 308, front panel 102, and rear panel 502, 504 form bag 100. Bag 100 has sleeves 140 attached to the front end 102. Front panel 102 is mounted in the front end of container 602 (shown in FIG. 6). Sleeves 104 have apertures 106 located at either end for accepting brace bars 202 (discussed more fully in regard to FIG. 2). The bag 100 may be constructed of a variety of materials commonly used for liner bags, such as polyethylene. The particular material selected will vary depending on the nature of the cargo. For example, transportation of foods will require material which will not react with the foods. Likewise, different density products will require different strength materials to ensure the structural integrity of bag 100. Liner materials and their structural strengths are well known in the art. The selection of a given material for a given commodity type will therefore be a design choice based on the chemical nature and physical character of the cargo.

In the preferred embodiment, sleeves 104 are heat sealed to front panel 102. Heat sealing is well known in the art. Those skilled in the art will recognize that a variety of other methods, such as chemical bonding, may also be used. Likewise, the number of sleeves 104 may vary. The only requirement is that the strength of the materials used for bag 100, sleeves 104, and the seals is such that bag 100 will not break and the sleeves 104 will remain securely attached to brace bars 202 and bag 100.

Figure 2:
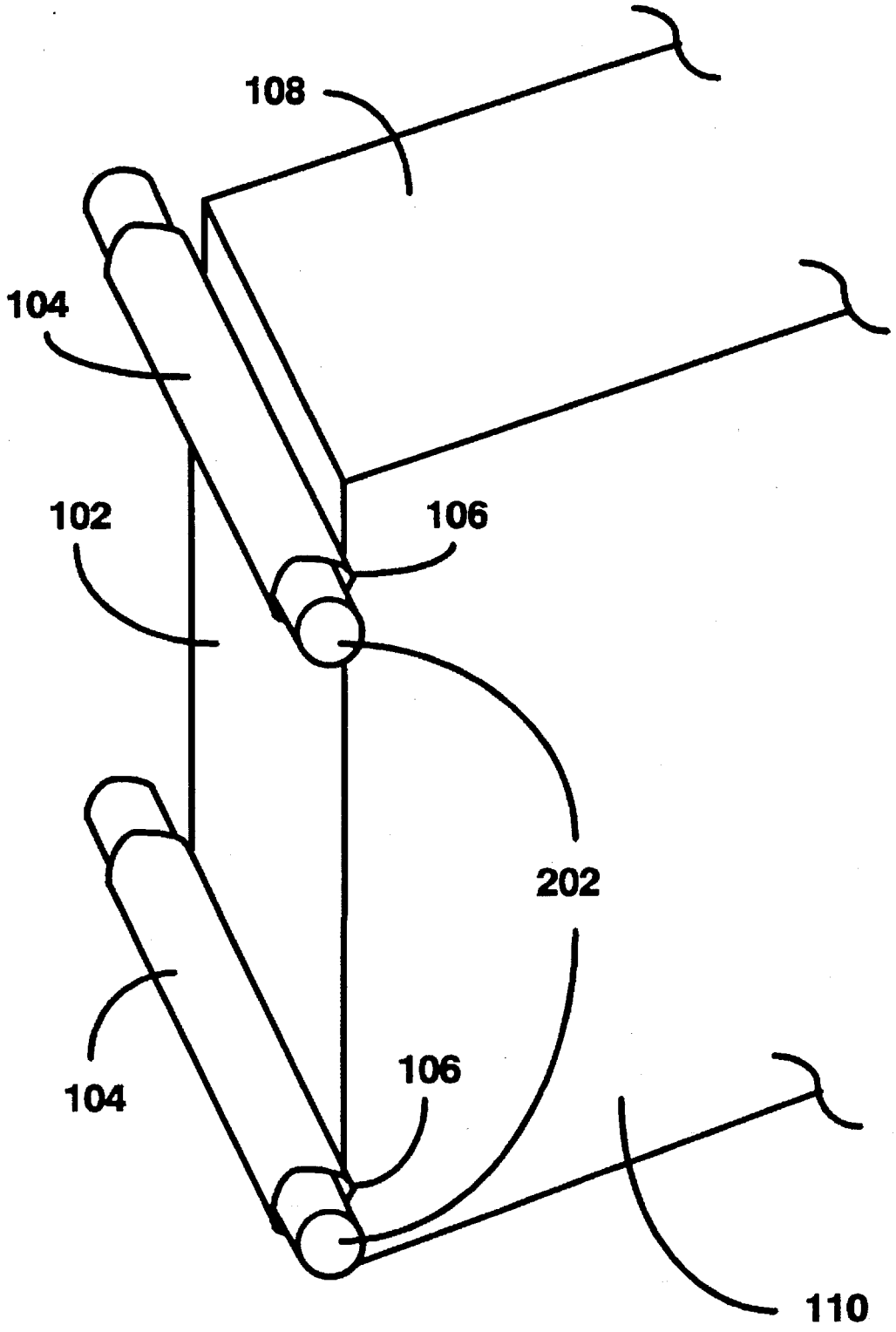
FIG. 2 is a cutaway view of the liner with brace bars inserted in the sleeves.

In FIG. 2, a cutaway front perspective view of bag 100 is shown. Brace bars 202 are inserted through apertures 106 of sleeves 104. For ease of illustration, brace bars 202 are shown extending beyond the width of front panel 102. Those skilled in the art will recognize that brace bars 106 and sleeves 104 can easily be configured such that bag 100 substantially fills the width of container 602. In addition, the size of brace bars 106 have been exaggerated to facilitate ease of view. In practice, brace bars 106 may be constructed of any suitable material such as wood or metal, and need only be strong enough to hold bag 100 in place.

In the preferred embodiment, two brace bars 106 are placed near the top and bottom of front panel 102. By so doing, the brace bars 106 act to position bag 100 such that it is fully expanded in the front of container 602. Of course, additional brace bars 106 could be added. Further, brace bars 106 can also be positioned vertically or otherwise in relation to bag 100. The only requirement is that brace bars 106 securely hold bag 100 in position near the front of container 602.

Figure 3:
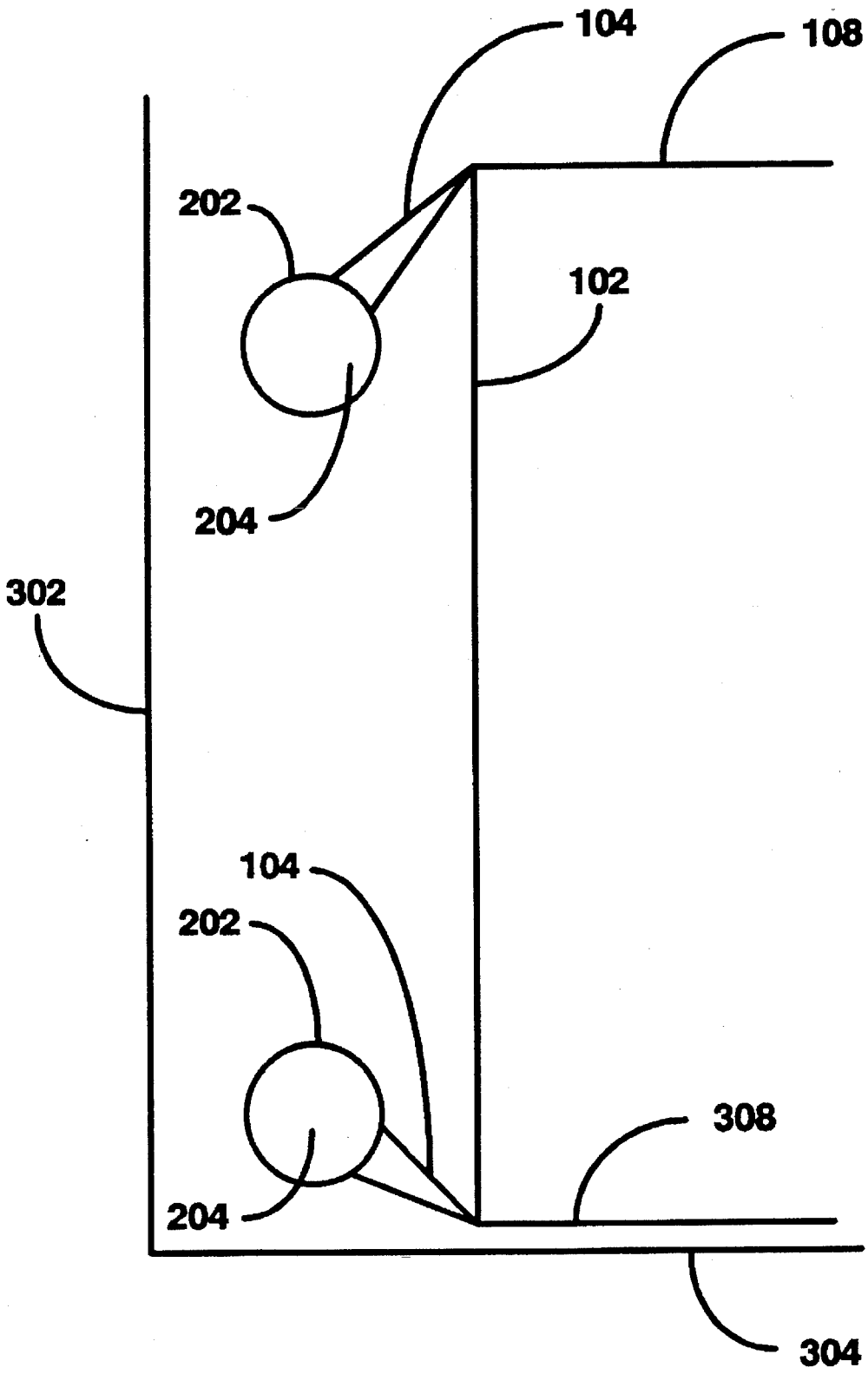
FIG. 3 is a cutaway side view of liner and brace bars secured to the front wall of the container.

FIG. 3 shows a side view of bag 100 mounted in container 602. In the preferred embodiment, front panel 102 of bag 100 is attached to sleeves 104 near the upper and lower edges of front panel 102. Of course, sleeves 104 can be attached to front panel 102 at points other than the edges, but the edge location provides for installing bag 100 in a more fully open position prior to loading. Brace bars 202 are shown inserted through sleeves 104. The grip pads 204 attached to the end of Brace bars 202 extend out from sleeves 104 and press against side wall 402. Floor panel 308 rests on the floor 304 of container 602. Front wall 302 of container 602 is shown for reference.

Figure 4:
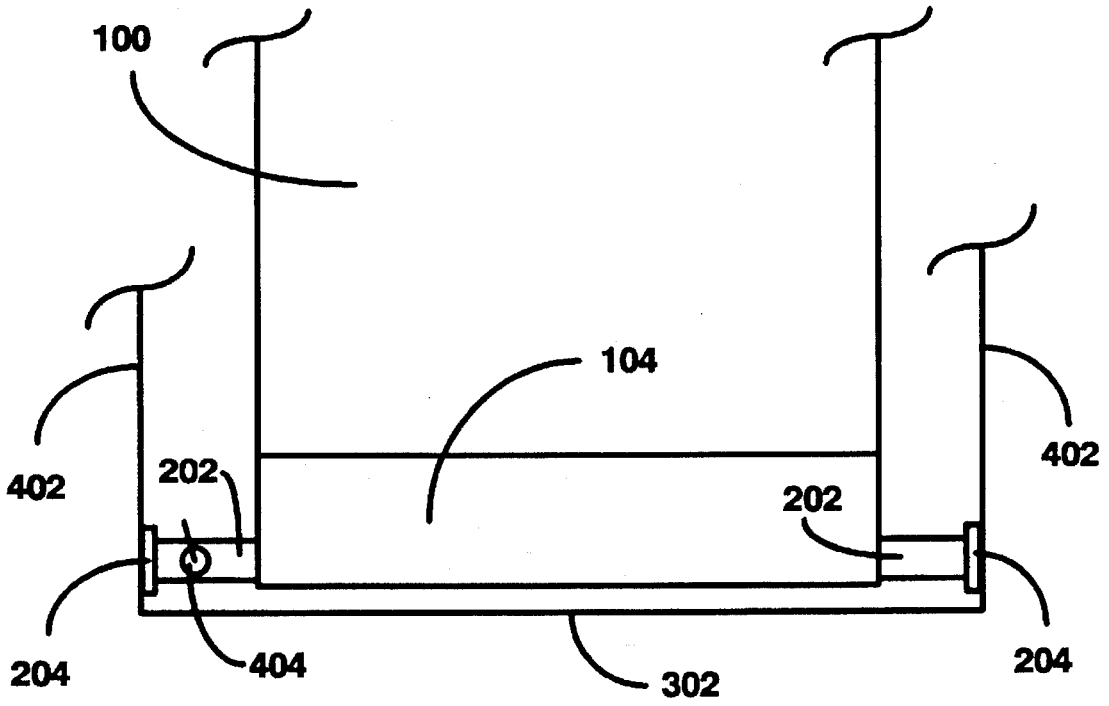
FIG. 4 is a cutaway top view of liner and brace bars secured to the front wall of the container.

FIG. 4 shows a top view of bag 100 discussed above in relation to FIG. 3. As mentioned above, the brace bars 202 are held against side walls 402 by grip pads 204. In practice, grip pads 204 would be surfaced with rubber or any other suitable material to prevent slippage when held against side walls 402. Tensioning device 404 is used to adjust the tension placed against side walls 402 by brace bar 202. Tensioning devices are well known in the art. Those skilled in the art will recognize that a variety of other methods, such as spring loaded devices, are suitable for use in applying tension with grip pads 204. In the preferred embodiment, sleeves 104 are constructed from a polyethylene fabric, but any suitable material may be substituted.

Figure 5:
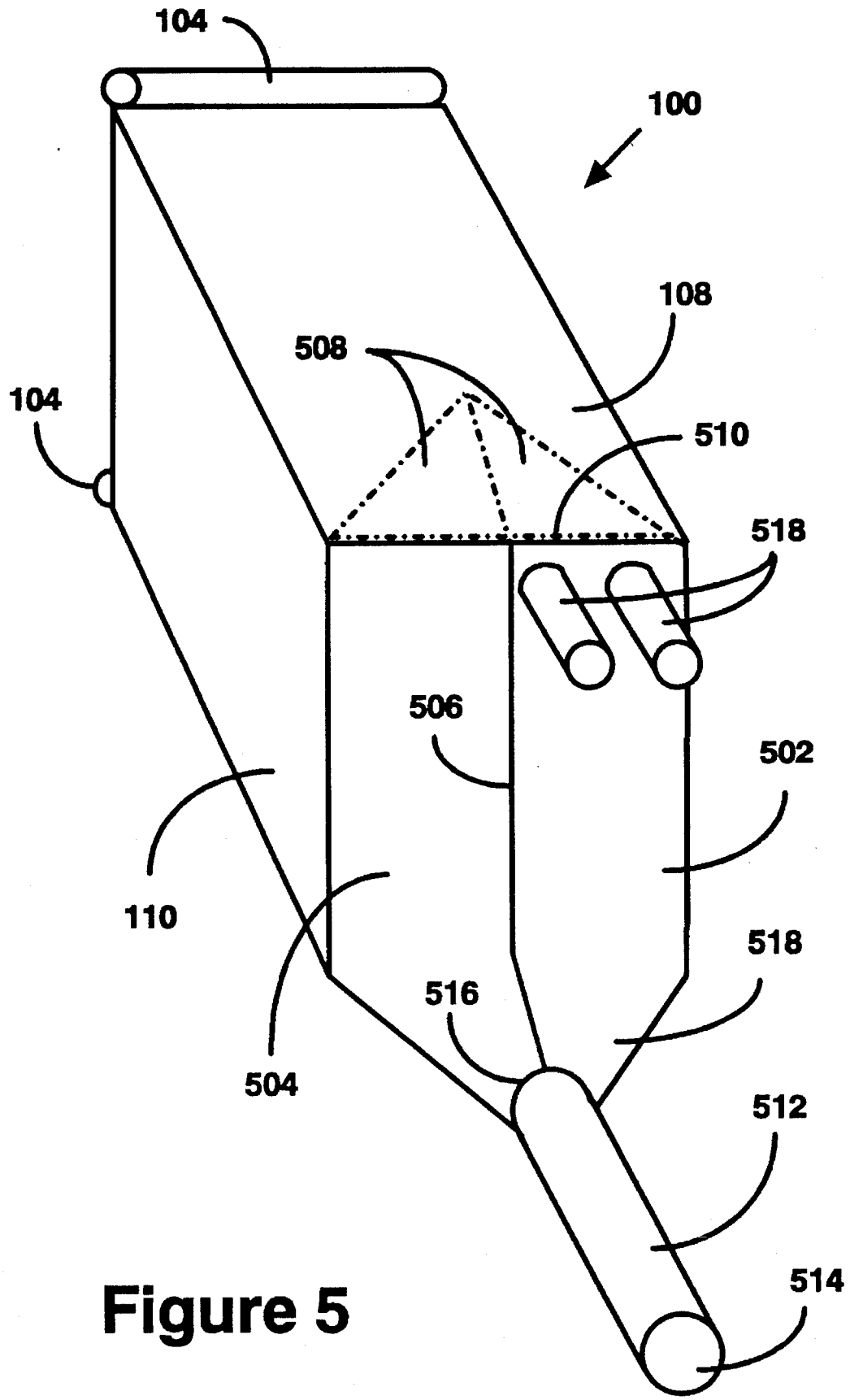
FIG. 5 is a rear perspective view of the liner showing the discharge funnel and discharge sleeve.

FIG. 5 shows a rear perspective view of bag 100. In the preferred embodiment, the rear portions 502, 504 of side panels 110 are folded inward and heat sealed together along seam 506 to form a rear panel 502, 504. Rear panel 502, 504 is the heat sealed to top panel 108 such the top portion of the rear of bag 100 is sealed. Floor panel 308 and rear portions 502, 504 are folded together and heat sealed to form a discharge funnel 518 as shown. Discharge sleeve 512 is then heat sealed to bag 100 at seam 516. Load/vent sleeves 518 are used to load bag 100 and provide venting to facilitate the loading and unloading operations.

Discharge port 514 is shown as open for illustrative purposes. Those skilled in the art will recognize that depending on the length of bag 100, discharge sleeve 512 may be formed from discharge funnel 518 rather than being added as a separate unit. Discharge sleeve 512 is closed during shipment of cargo in bag 100. Sleeve 512 may be held closed by any suitable means such as tying, heat sealing, etc. In the case of heat sealing, discharge sleeve 514 can easily be opened by cutting the end of the sleeve off. Likewise, the length of discharge sleeve may be any suitable length so long as it allows for convenient unloading of cargo.

Figure 6:
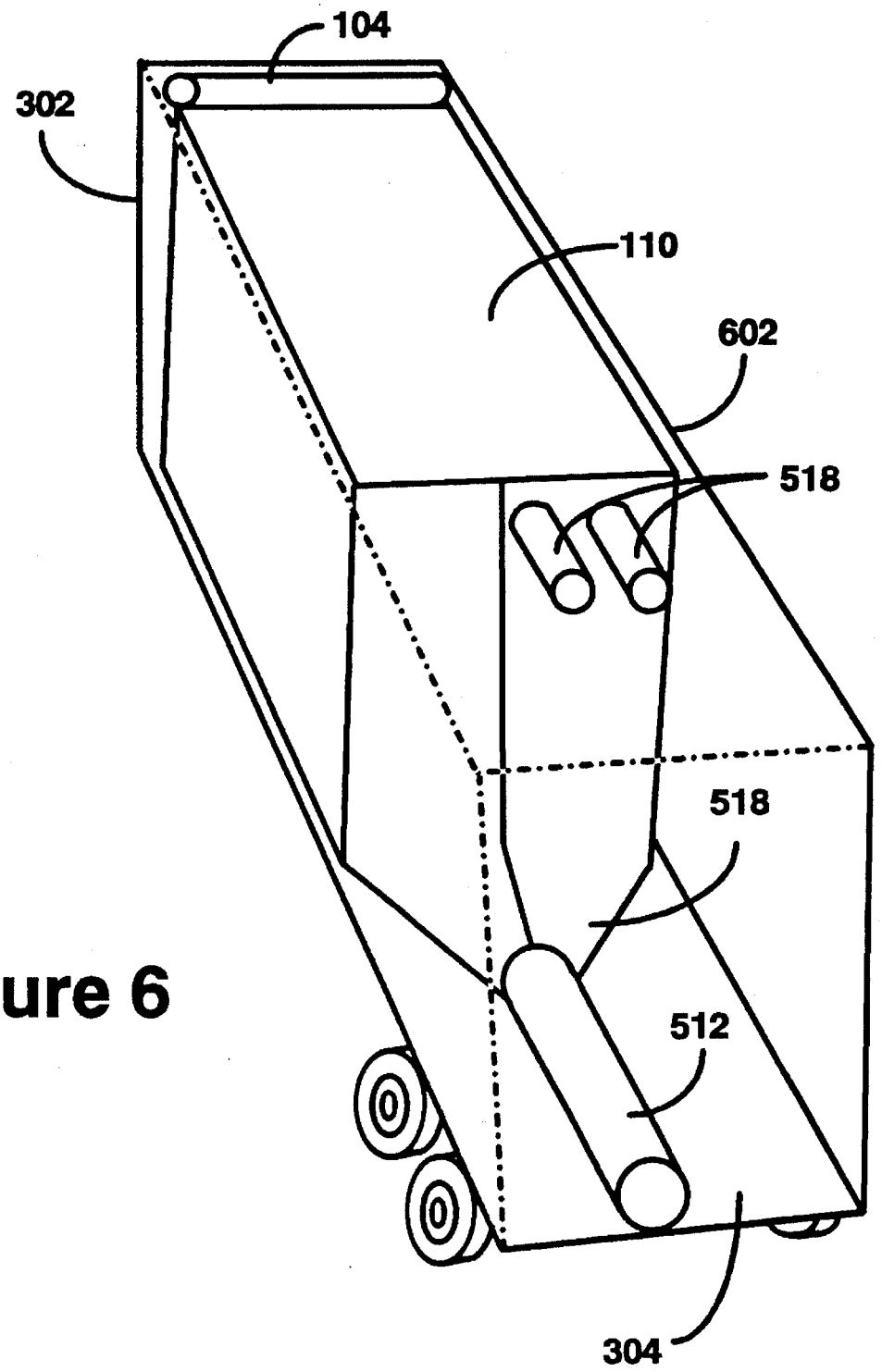
FIG. 6 is a cutaway view of a container showing the positioning of the liner within the container.

FIG. 6 is a cutaway perspective end view of container 602 which shows the liner positioned within. As can be seen, sleeves 104 secure the liner to the front wall 302 of container 602. Liner 100 is shorter in length than container 602 to allow discharge funnel 518 to rest on the floor 304 of container 602. Discharge sleeve 512 is shown as extended for illustrative purposes. In practice, discharge sleeve 518 would be tied off in an appropriate manner and fold back in any convenient location. Therefore, discharge funnel 518 may actually end close to the door of container 602. By selecting a length for bag 100 which is less than the length of container 602, and by securing bag 100 to the front wall 302 of container 602, a bulkhead is not required at the rear door of container 602. This results in a reduction in cost and easier loading and unloading.

During the unloading operation, discharge sleeve 512 is unfolded, connected to the appropriate unloading hopper (not shown), and untied such that cargo can drain out of bag 100 through discharge funnel 518 and discharge sleeve 512. Sleeves 518 provide venting when appropriate. After discharge sleeve 518 is attached to the unloading hopper and opened, and as long as cargo is flowing from bag 100, the front end of container 602 is not raised. When cargo reaches an angle of repose and stops flowing from discharge sleeve 518, container 602 is slowly raised at the front end until cargo begins to flow again. When cargo begins to flow, the raising is stopped. This process is repeated until the liner is completely unloaded. The reason for this is to minimize pressure on rear panel 502, 504, on seams 506, 510, 516 and on sleeves 104 and their respective seals. By gradually raising container 602, stress is kept at minimum levels.

Through the use of brace bars and sleeves at the front end of container 602, bag 100 does not have to be secured by prior art methods, such as nailing, which inflict some damage to the container each time a liner is installed. Further, a liner can be installed much faster with this method as opposed to prior art approaches which require more work to secure the liner. By using a liner bag 100 which is shorter than the container 602, the bulkhead can be eliminated along with the costs associated its construction and the labor required to install it. Since container trucks are general not able to be completely filled due to the weight of the cargo, the reduced length of bag 100 may not adversely effect the efficiency of container 602. In addition, by forming a discharge funnel 518 at the rear of bag 100, it is possible to efficiently unload bag 100 without having the costs associated with bevelled corner units such as those found in the art. As was the case with the bulkheads, both construction and labor costs are eliminated.

Figure 7:
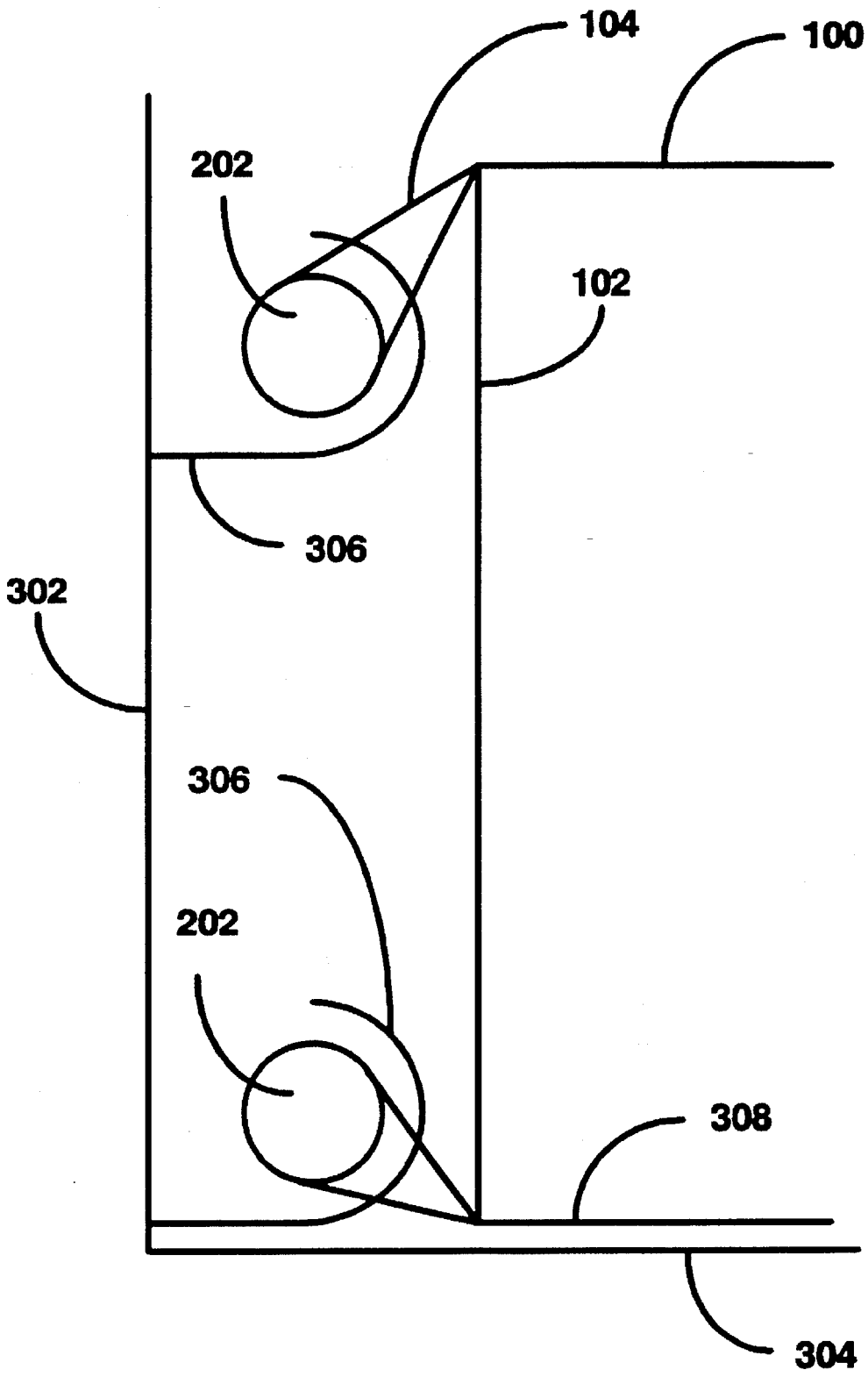
FIG. 7 is an alternative embodiment showing a cutaway view of the liner and brace bars secured to the front wall of the container by hooks.

FIG. 7 shows an alternative embodiment to the brace bar 202 discussed above in relation to FIG. 3. In this embodiment, a side view of bag 100 mounted on front wall 302 of container 602 is shown. Front panel 102 of bag 100 is attached to sleeves 104 near the upper and lower edges of front panel 102. Brace bars 202 are shown inserted through sleeves 104. Brace bars 202 extend out from sleeves 104 and rest in brackets 306 which are secured to front wall 302. Floor panel 308 rests on the floor 304 of container 602. In this embodiment, grip pads 204 are not required.

Figure 8:
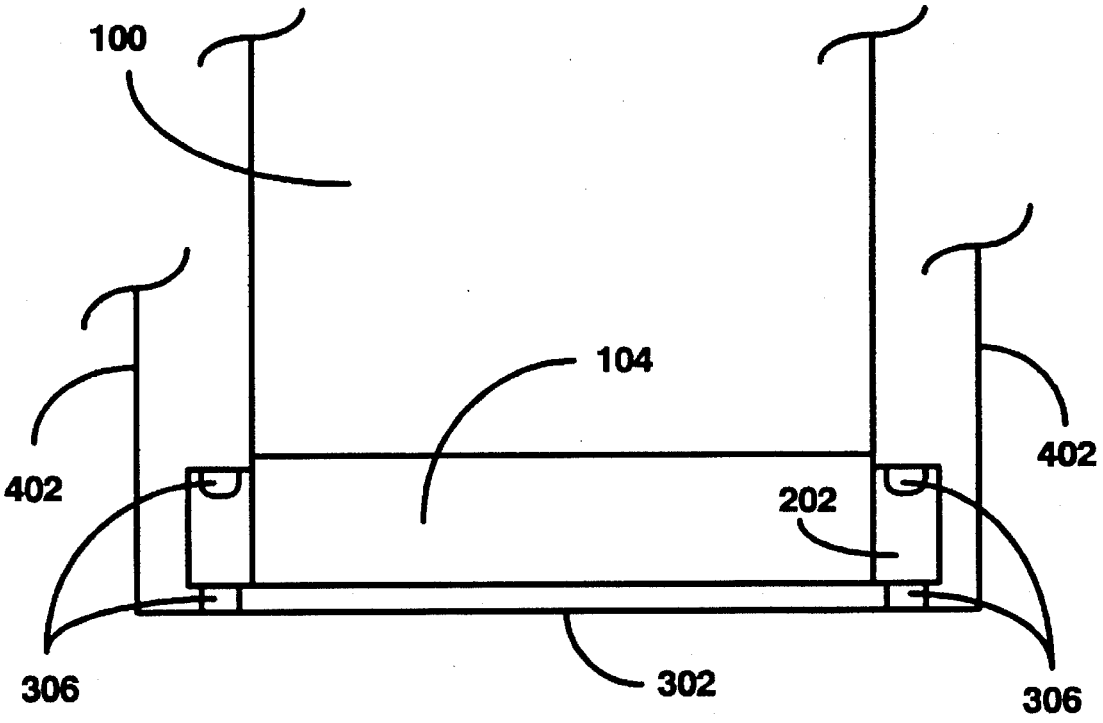
FIG. 8 is an alternative embodiment showing a cutaway top view of liner and brace bars secured to the front wall of the container by hooks.

FIG. 8 shows a top view of bag 100 discussed above in relation to FIG. 7. As mentioned above, brace bars 202 are illustrated as being longer than sleeves 104 for convenience. However, a variety of means can be used to keep the width of bag 100 as wide as container 602. For example, sleeves 104 can be shorter than the width of bag 100. Likewise, slots can be cut in sleeves 104 to allow brackets 306 to be attached to brace bars 202 away from the ends of brace bars 202. Those skilled in the art will also recognize that while brackets 306 are shown attached to front wall 302, it would be an easy matter to attach then to side wall 402. In the preferred embodiment, bag 100 would rest against the side walls 402 of container 602.

Figure 9:
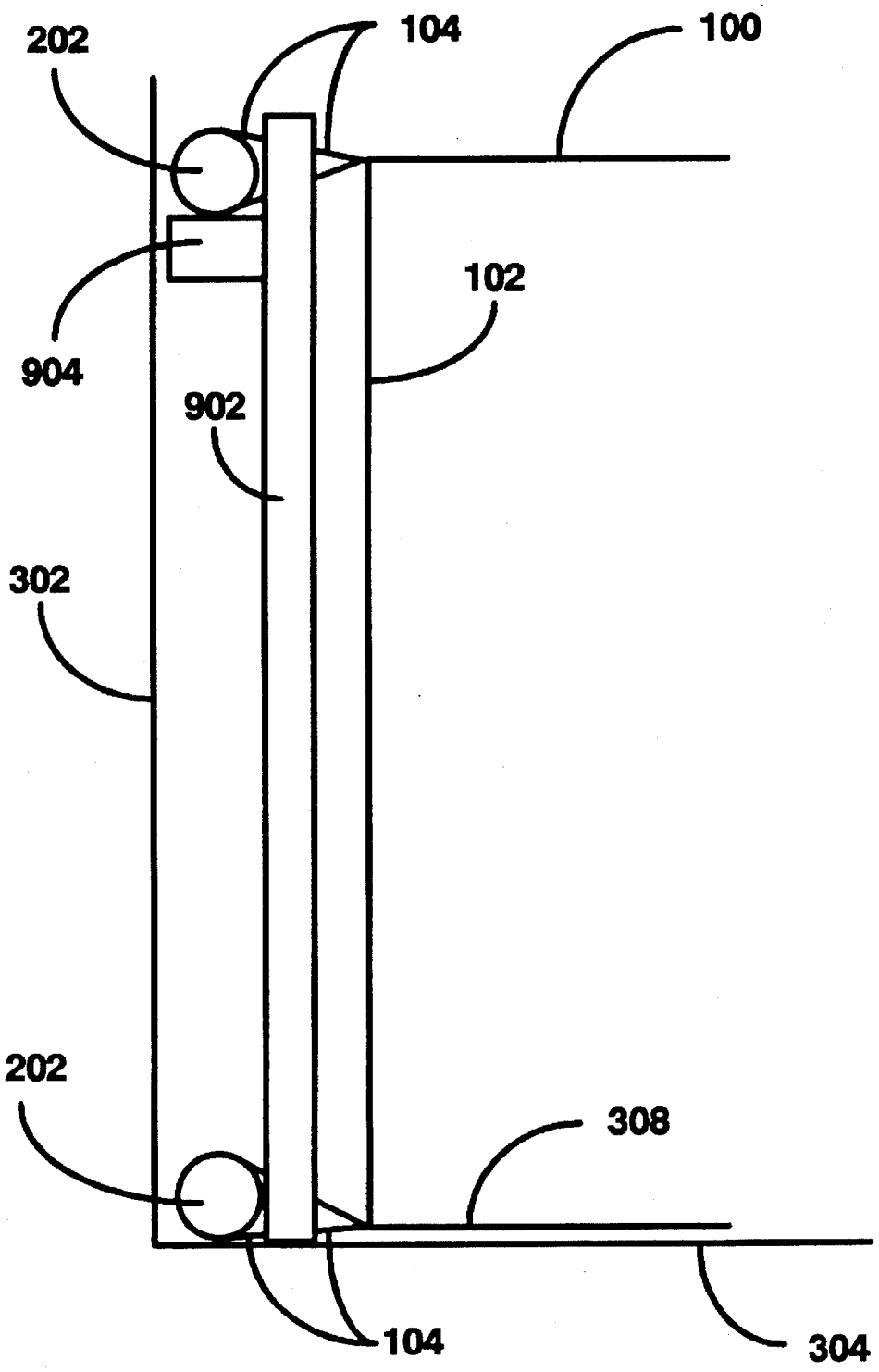
FIG. 9 is an alternative embodiment showing a cutaway view of the liner and brace bars secured to the front wall of the container by corner posts.

FIG. 9 shows another alternative embodiment to the brace bar 202 discussed above in relation to FIG. 3. In this embodiment, a side view of bag 100 mounted on front wall 302 of container 602 is shown. Front panel 102 of bag 100 is attached to sleeves 104 of front panel 102. Brace bars 202 are shown inserted through sleeves 104. Brace bars 202 extend out from sleeves 104 and are held behind corner post 902. The upper brace bar 202 rests on brackets 904 which is secured to corner post 902. Brackets 904 can be permanently or removably attached to corner post 902 or to a side of container 602. Any suitable method of construction for brackets 904 will suffice so long as brace bar 202 is held in position. The lower brace bar can rest on an addition bracket 904 (not shown) or on the floor 304 of container 602, whichever provides the most convenient position. Floor panel 308 rests on the floor 304 of container 602. In this embodiment, grip pads 204 are not required.

Figure 10:
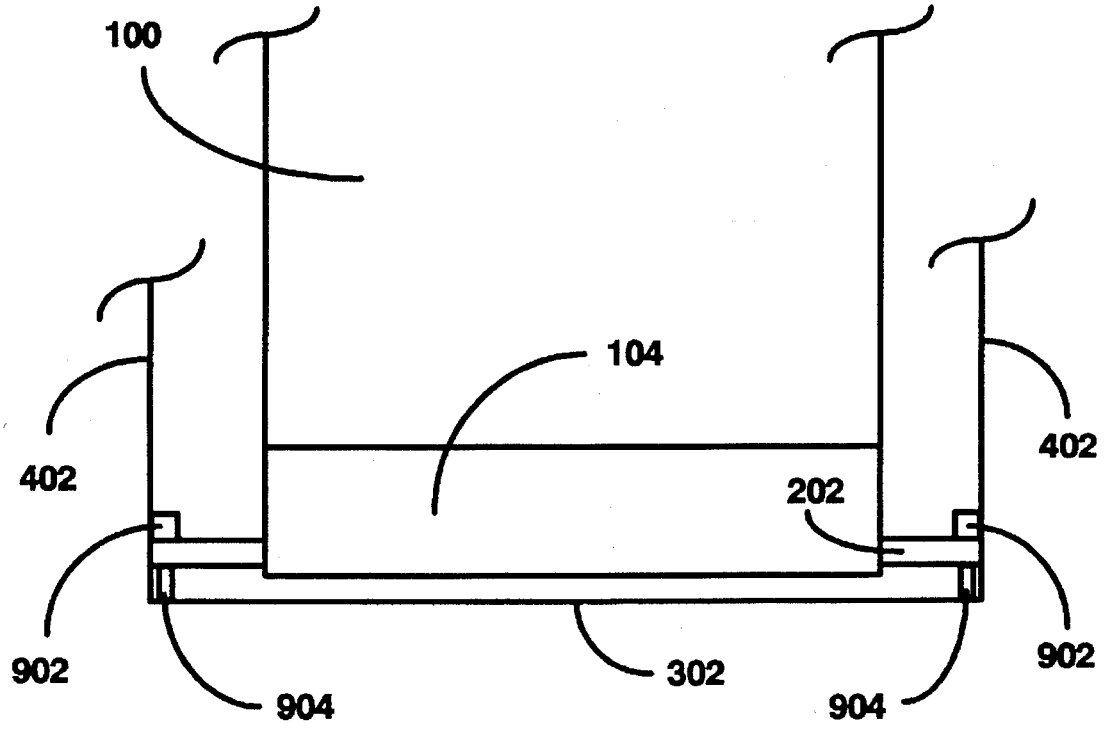
FIG. 10 is an alternative embodiment showing a cutaway top view of liner and brace bars secured to the front wall of the container by corner posts.

FIG. 10 shows a top view of bag 100 discussed above in relation to FIG. 9. Brace bars 202 are inserted behind corner post 902 at an angle when bag 100 is empty. Brackets 904 prevent brace bars 202 from moving below the desired location.

Those skilled in the art will also recognize that while the various embodiments show brace bars 202 held by front wall 302 or side walls 402, various changes in configuration can easily be made.

Previously, sleeves 104 were envisioned as separately constructed components for attachment to bag 100. FIG. 11 shows an alternative embodiment of construction for sleeve 104. In this embodiment, sleeves 104 are construct from an end portion of bag 100. As can be seen in FIG. 11-A, bag 100 has side portion 1102 and end portion 1104. In FIG. 11-B, end portions 1104 are folded over and seamed together. In the preferred embodiment, end portions 1104 are heat sealed together. Due to the folding process, end flaps 1106 project upward and downward from bag 100. End flaps 1106 are heat sealed to side portions 1102 at seam 1108. In FIG. 11-C, excess material from end flaps 1106 is cut away and the remaining material from end flaps 1106 is rolled to form sleeves 104 and then heat sealed in position. By this method, bag 100 and sleeves 104 can be manufactured from the same piece of liner tube material.

Figure 12:
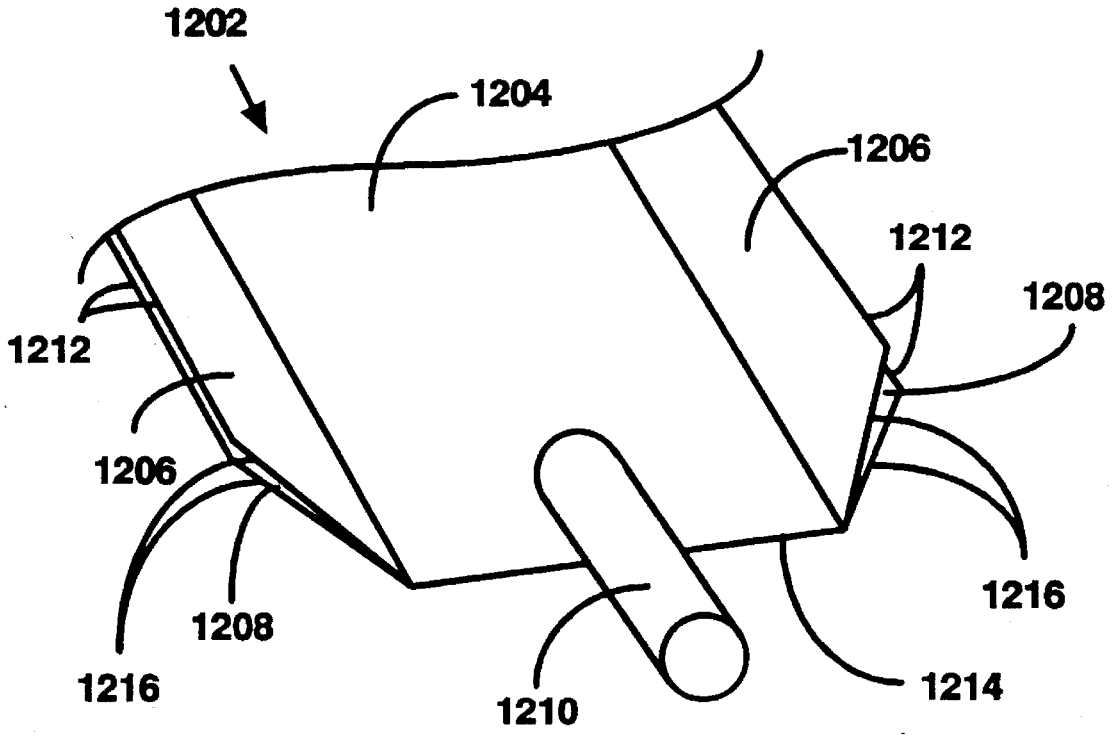
FIG. 12 is an alternative embodiment of the liner in a flattened state showing the liner discharge funnel attached to the upper portion of the liner.

FIG. 12 shows an alternative embodiment of the liner 1202 in which the liner 1202 is constructed such that it folds flat when empty, the liner 1202 has an upper surface 1204, a bottom surface 1304 (shown in FIG. 13) and folding side sections 1206, 1208 which fold along side edges 1212. Folding side sections 1206, 1208 are seamed such that end edges 1216 taper back from rear seam 1214 to allow liner 1202 to take the desired shape when filled. In this embodiment, discharge funnel 1210 is attached to the upper surface 1204 of liner 1202. The attachment at a raised elevation reduces the possibility of blockage of the funnel 1210 during discharge as compared to the previously disclosed embodiments. As the cargo is unloaded and liner 1202, the container is typically raised such that cargo is continuously moving through funnel 1210. For ease of illustration, other details of the liner, such as load/vent sleeves 518 are not shown in this figure or in FIGS. 13 through 17.

Figure 13:
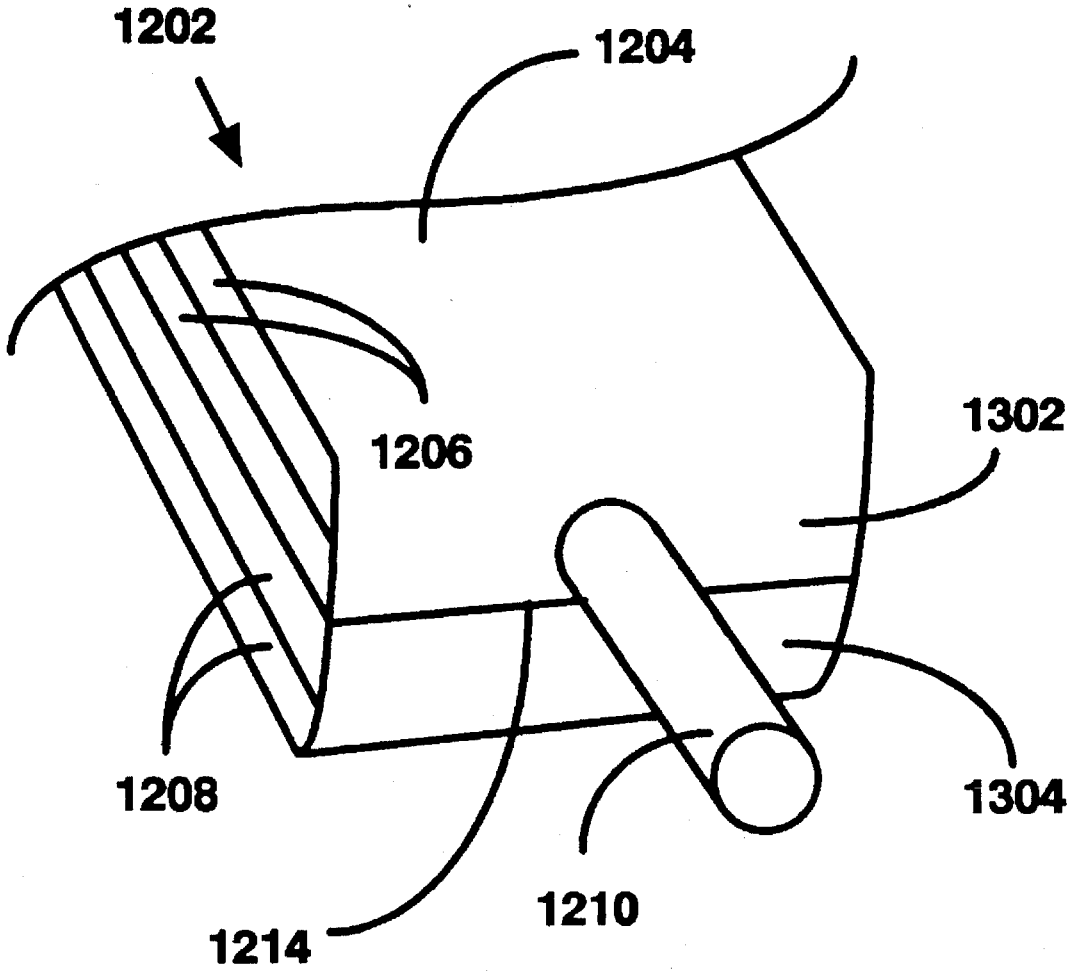
FIG. 13 is the liner of FIG. 12 in an expanded state showing the liner discharge funnel attached to the upper portion of the liner.

FIG. 13 illustrates the shape of liner 1202 when filled. When liner 1202 is filled, the rear end 1302 of the upper surface 1204 and the rear end 1304 of the lower surface 1204 bend to form a rear wall 1302, 1304 such that rear seam 1214 extends across the middle zone of the rear wall 1302, 1304.

Figure 14:
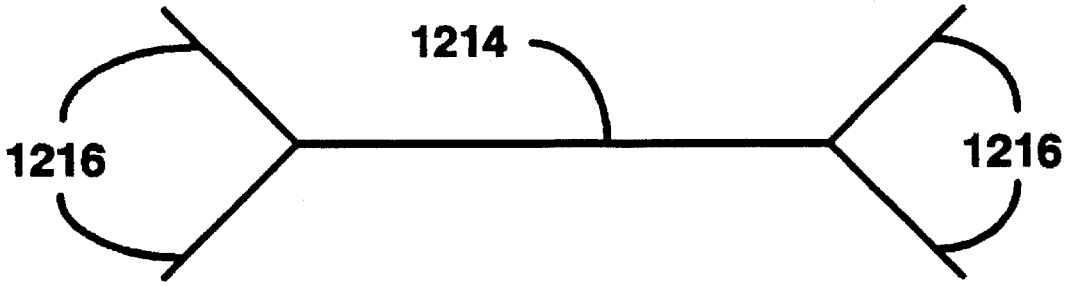
FIG. 14 is the seam of the liner of FIG. 12 showing the modified X seam used to seal the rear end of the liner.

FIG. 14 illustrates an end view of the modified "X" seam used in the embodiments shown in FIGS. 12 through 18.

Figure 15:
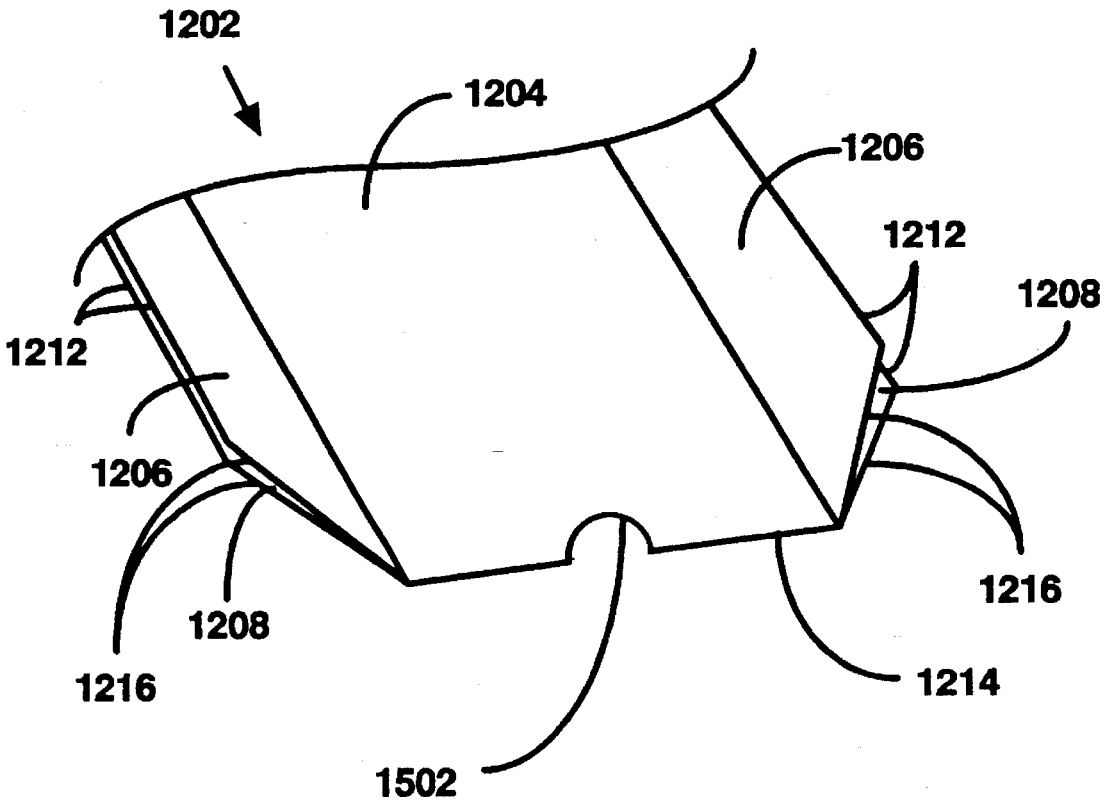
FIG. 15 is another alternative embodiment of the liner in a flattened state showing the liner discharge funnel port located at the center portion of the liner.

FIG. 15 illustrates an alternative embodiment to the liner 1202 discussed above in relation to FIGS. 12 and 13. In this embodiment, the aperture for attaching funnel 1210 is located on the seam 1214 such that it will be approximately in the middle of the rear wall 1302, 1304 of the liner 1202 when liner 1202 is filled. This embodiment also has a reduced chance of blockage of discharge funnel 1210 due to the raised elevation of the discharge funnel 1210 on the rear wall 1302, 1304.

Figure 16:
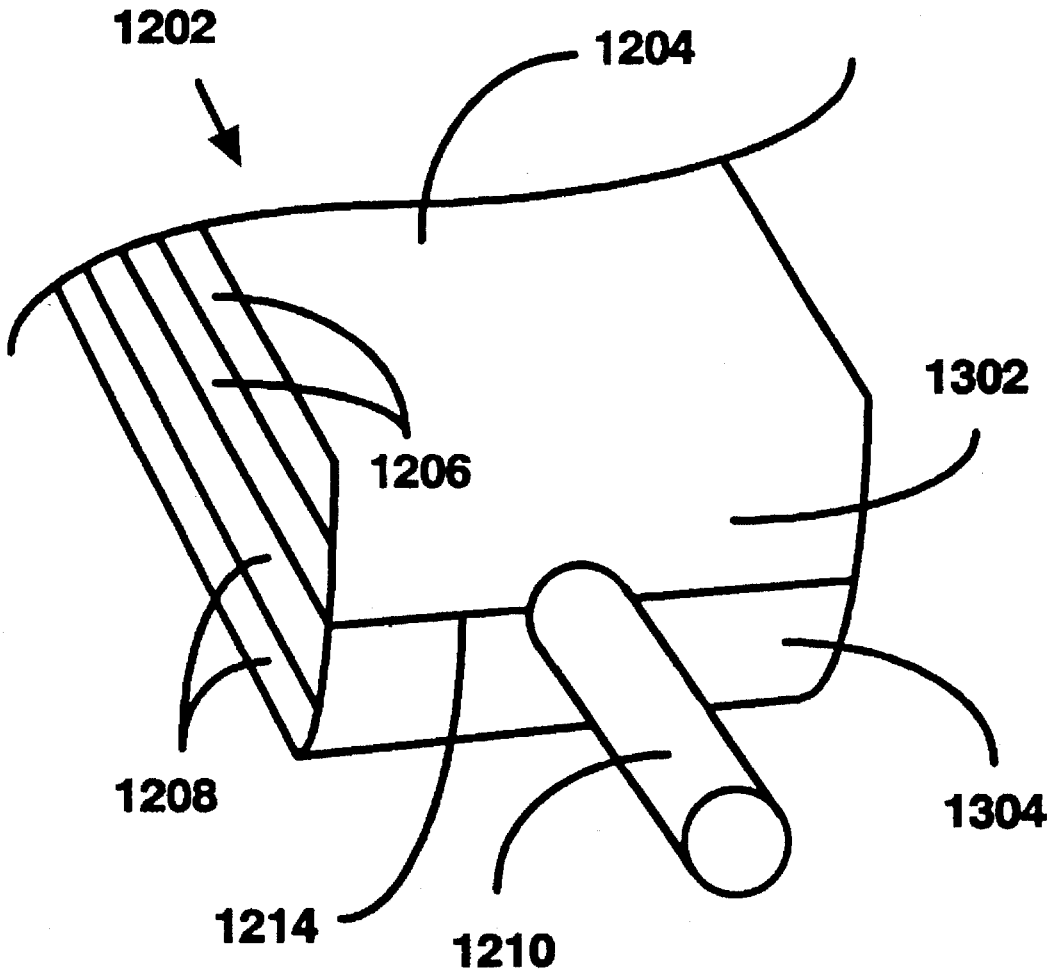
FIG. 16 is the liner of FIG. 15 in an expanded state showing the liner discharge funnel port located at the center portion of the liner.

FIG. 16 illustrates the liner 1202 of FIG. 15 when filled.

Figure 17:
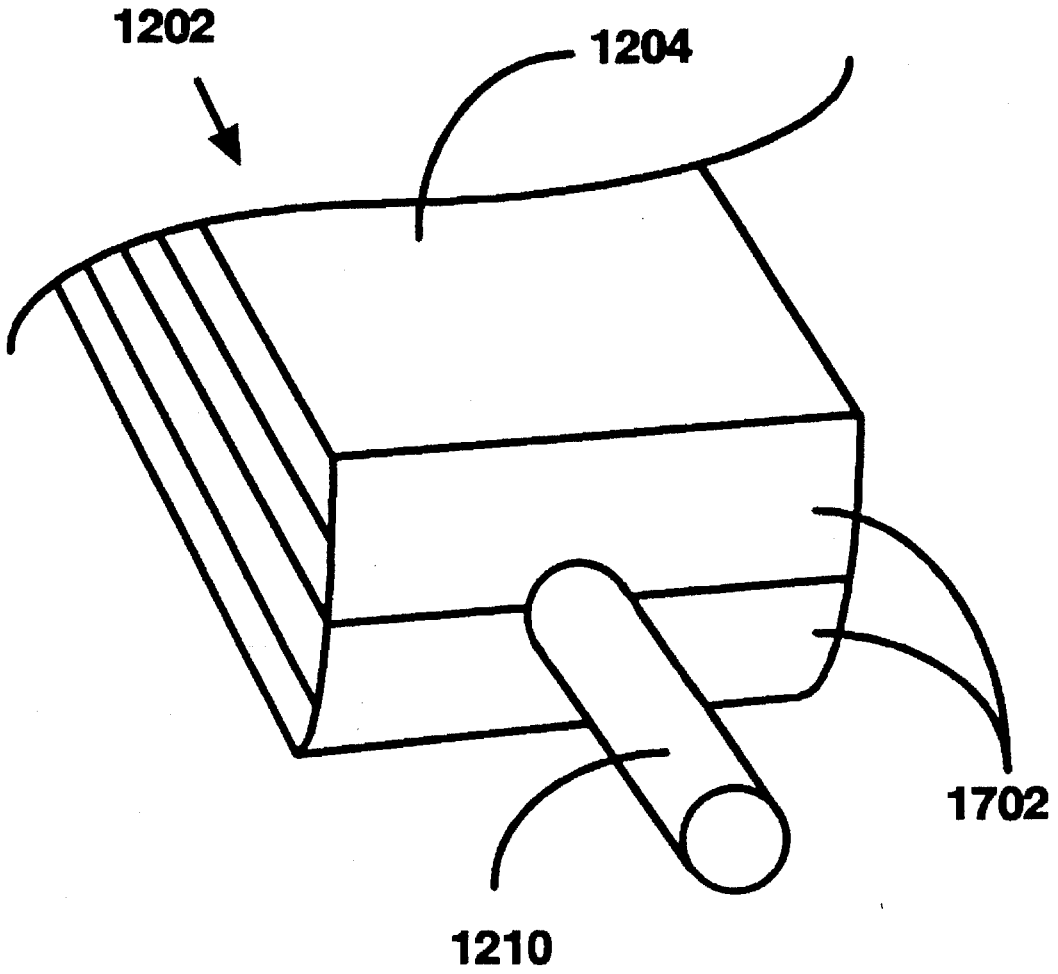
FIG. 17 shows reinforcement panels which can be used by any of the embodiments herein.

FIG. 17 shows the liner 1202 with a reinforced end wall 1702. While the liner itself will suitably hold a variety of cargo types with liner thicknesses ranging approximately from 6 mils upward to 40 mils, it has been found that the rear wall 1302, 1304 is subjected to the greatest amount of pressure, especially during the unloading operation. Therefore, by reinforcing the rear wall 1302, 1304 a thinner liner can be effectively used. The preferred embodiment envisions a layer of woven polyethylene or woven polypropylene laminated to the rear wall 1302, 1304 of liner 1202.

Figure 18:
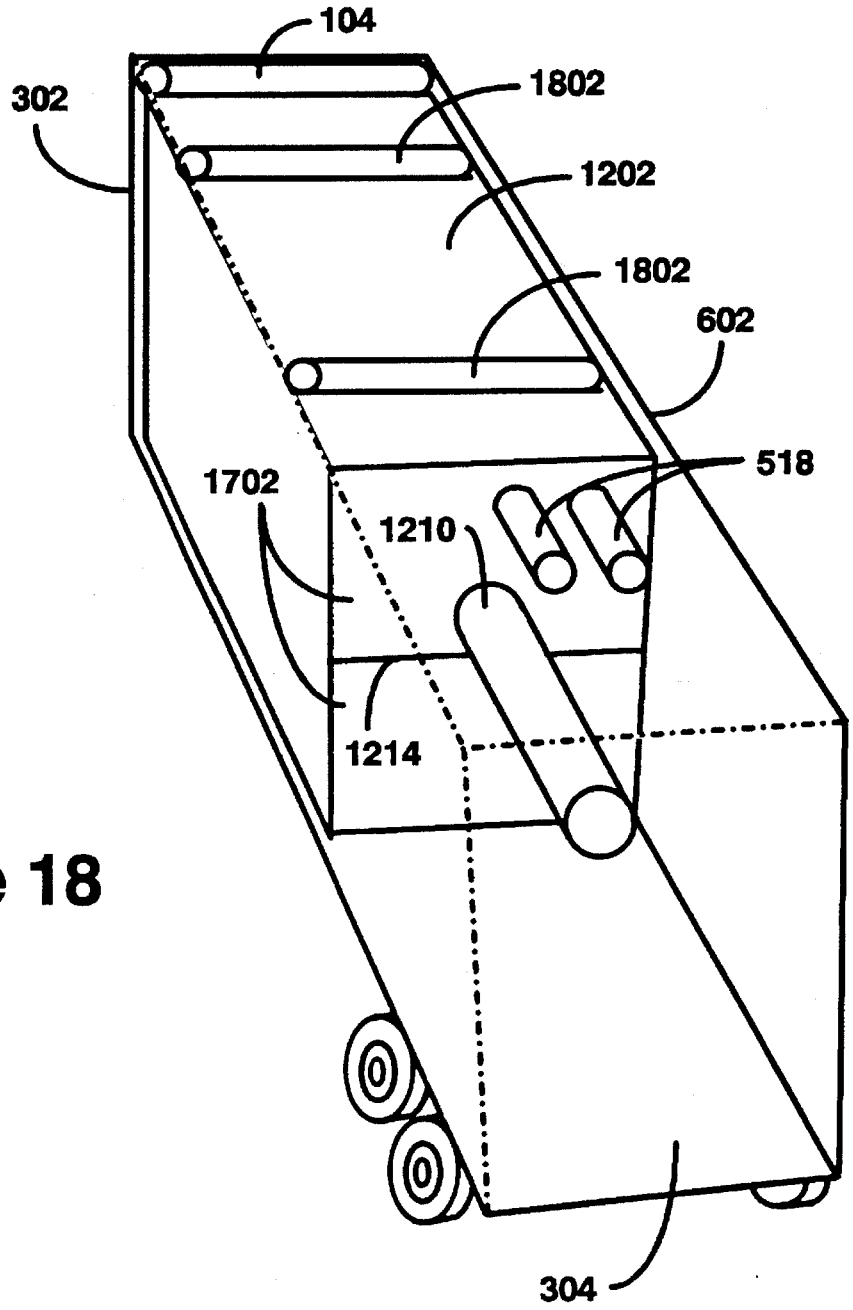
FIG. 18 is an alternative embodiment showing the liner of FIG. 12 with the reinforcement panels of FIG. 17 and further including ceiling sleeves on the upper surface of the liner which is positioned within the container.

FIG. 18 shows the liner 1202 positioned in a container. An additional optional feature is also shown in this figure which was not heretofore discussed. In this figure, upper sleeves 1802 were added to the top of the liner 1202 to allow the liner to be suspended in an open position during unloading. These sleeves 1802 are constructed in the same manner as the sleeves 104 discussed previously.

While the preferred embodiment was discussed in terms of a standard liner material for ease of illustration, those skilled in the art will recognize that the liner will be constructed at times from reinforced material in cases where high strength is require. In addition, while the preferred embodiment envisions the use of heat seals to secure the various parts of the liner together, the liner components can also be integrated via other methods, such as chemical bonding, or sewing and stitching. In addition, the funnel can be an integral part of the liner or it can be a prefabricated funnel made of ordinary liner material or of reinforced material such as the woven reinforcements discussed above. Likewise, the entire liner can be fabricated from reinforced material in cases where high liner strength is desirable.

While the invention has been described with respect to a preferred embodiment thereof, it will be understood by those skilled in the art that various changes in detail my be made therein without departing from the spirit, scope, and teaching of the invention. For example, the material used to construct the liners may be anything suitable for a particular cargo, the orientation and mounting techniques used for the brace bars can vary, the shape of the funnel can vary, etc. Likewise, the discharge sleeve can be any convenient length, and depending on the length and shape of the funnel, may even be optional. Accordingly, the invention herein disclosed is to be limited only as specified in the following claims.

I claim:

1. A liner for transportation of bulk cargo in a front brace bar equipped transport container of the type having a floor, a ceiling, sidewalls, a front wall and a rear door, comprising:

an elongated bag of flexible sheet material, the bottom of the bag supported by the floor of the container, the bag further having a rear end located near the door of the container and a front end located substantially near the front wall of the container;

a forward liner wall formed by folding two opposing edges of the front portion of the flexible bag such that they come in contact and sealing the opposing edges together;

at least one seam formed by sealing the forward liner wall to the top of the flexible bag the seam formed such that top flap is created;

at least one seam formed by sealing the forward wall to the bottom of the flexible bag, the seam formed such that a bottom flap is created; and a first securing sleeve sealed to the bag near the front end, the first securing sleeve formed by rolling the bottom flap or the top flap into a sleeve and sealing the sleeve to the flexible bag, the first securing sleeve having apertures for accepting a brace bar secured to the container near the front wall.

2. A liner, as in claim 1, further comprising a second securing sleeve sealed to the bag near the front end, the second securing sleeve having apertures for accepting a second brace bar secured to the container near the front wall.

3. A liner, as in claim 2, wherein when the liner is installed in a container, the first securing sleeve is located substantially adjacent to the front wall of the container and substantially adjacent to a first side wall of the container, and the second securing sleeve is located substantially adjacent to the front wall of the container and substantially adjacent to a second side wall of the container.

4. A liner, as in claim 3, wherein the first side wall of the container is the floor of the container, and the second side wall of the container is the ceiling of the container.

5. A liner, as in claim 1, further comprising a second securing sleeve sealed to the bag on the top surface of the bag, the second securing sleeve having apertures for accepting a second brace bar secured to the container near the ceiling.

6. A liner system for transportation of bulk cargo in a transport container of the type having a floor, a ceiling, sidewalls, a front wall and a rear door, comprising:

an elongated bag of flexible sheet material, the bottom of the bag supported by the floor of the container, the bag further having a rear end located near the door of the container and a front end located substantially near the front wall of the container;

a forward liner wall formed by folding two opposing edges of the front portion of the flexible bag such that they come in contact and sealing the opposing edges together;

at least one seam formed by sealing the forward wall to the top of the flexible bag, the seam formed such that a top flap is created;

at least one seam formed by sealing the forward wall to the bottom of the flexible bag, the seam formed such that a bottom flap is created;

a first securing sleeve sealed to the bag near the front end, the first securing sleeve formed by rolling the bottom flap or the top flap into a sleeve and sealing the sleeve to the flexible bag, the first securing sleeve having apertures for accepting a brace bar; and at least one brace bar, the brace bar removably secured to a wall of the container on or near the front wall, the brace bar of a size such that it can be inserted into the securing sleeve prior to being secured to the container.

7. A liner system, as in claim 6, further comprising:

a second securing sleeve sealed to the bag near the front end, the second securing sleeve having apertures for accepting a second brace bar; and a second brace bar secured to the container on or near the front wall.

8. A liner system, as in claim 7, wherein the first securing sleeve is located substantially adjacent to the front wall of the container and substantially adjacent to a first side wall of the container, and the second securing sleeve is located substantially adjacent to the front wall of the container and substantially adjacent to a second side wall of the container.

9. A liner system, as in claim 8, wherein the first side wall of the container is the floor of the container, and the second side wall of the container is the ceiling of the container.

10. A liner, as in claim 6, wherein the brace bar is secured by brackets to the front wall.

11. A liner, as in claim 6 wherein the brace bar is secured to the side wall by grip pads.

12. A liner, as in claim 6, wherein the brace bar is secured by corner posts.

13. A liner for transportation of bulk cargo in a transport container of the type having a floor, a ceiling, sidewalls, a front wall and a rear door, comprising:

an elongated bag of flexible sheet material, the bottom of the bag supported by the floor of the container, the bag further having a rear end located near the door of the container and a front end located substantially near the front wall of the container; and the edges of two opposing sides of the rear end of the liner are sealed together such that the rear end of the liner folds together form a rear liner wall, the top of the liner and the top edge of the rear liner wall are sealed together enclosing the bag at the top, the lower portion of the opposing sides are sealed together such that a funnel is formed near the bottom of the rear end of the bag.

14. A liner, as in claim 13, wherein the length of the liner is less than the length of the container such that at least a portion of the funnel extends along the floor of the container when the liner is filled.

15. A liner, as in claim 14, further comprising a discharge sleeve connected at a first end to the funnel, and sealed to the funnel such that a path for commodities is formed from the liner bag through the funnel and then through the sleeve, the second end of the sleeve forming a discharge aperture for unloading the bag.

16. A liner, as in claim 15, wherein the seals are heat seals.

17. A liner, as in claim 15, further comprising:

a first securing sleeve sealed to the bag near the front end, the first securing sleeve having apertures for accepting a brace bar; and at least one brace bar, the brace bar removably secured to a wall of the container on or near the front wall, the brace bar of a size such that it can be inserted into the securing sleeve prior to being secured to the container.

18. A liner, as in claim 17, further comprising:

a second securing sleeve sealed to the bag near the front end, the second securing sleeve having apertures for accepting a second brace bar; and a second brace bar secured to the container on or near the front wall.

19. A liner, as in claim 18, wherein the first securing sleeve is located substantially adjacent to the front wall of the container and substantially adjacent to a first side wall of the container, and the second securing sleeve is located substantially adjacent to the front wall of the container and substantially adjacent to a second side wall of the container.

20. A liner, as in claim 16, wherein the first side wall of the container is the floor of the container, and the second side wall of the container is the ceiling of the container.

21. A liner for transportation of bulk cargo in a transport container of the type having a floor, a ceiling, sidewalls, a front wall and a rear door, comprising:

an elongated bag of flexible sheet material, the bottom of the bag supported by the floor of the container, the bag further having a rear end located near the door of the container and a front end located substantially near the front wall of the container;

the edges of two opposing sides of the rear end of the liner are sealed together such that the rear end of the liner folds together form a rear liner wall; and a discharge funnel extends from the rear liner wall.

22. A liner, as in claim 21, further comprising a reinforced layer integrated with the rear liner wall to increase rear liner wall strength during unloading.

23. A liner, as in claim 22, wherein the reinforced layer is laminated to the rear liner wall strength during unloading.

24. A liner, as in claim 23, wherein the reinforced layer is woven polyethylene.

25. A liner, as in claim 24, wherein the reinforced layer is woven polypropylene.

26. A liner, as in claim 6, further comprising a second securing sleeve sealed to the bag on the top surface of the bag, the second securing sleeve having apertures for accepting a second brace bar secured to the container near the ceiling.

27. A liner, as in claim 17, further comprising a second securing sleeve sealed to the bag on the top surface of the bag, the second securing sleeve having apertures for accepting a second brace bar secured to the container near the ceiling.

28. A liner, as in claim 21, further comprising:

a first securing sleeve sealed to the bag near the front end, the first securing sleeve having apertures for accepting a brace bar secured to the container near the front wall; and a second securing sleeve sealed to the bag on the top surface of the bag, the second securing sleeve having apertures for accepting a second brace bar secured to the container near the ceiling.

* * * * *